US012128934B2

(12) United States Patent
Coston et al.

(10) Patent No.: US 12,128,934 B2
(45) Date of Patent: Oct. 29, 2024

(54) RAILCAR EXTENSIONS FOR INCREASED STRUCTURE WIDTH

(71) Applicant: TRINITY RAIL GROUP, LLC, Dallas, TX (US)

(72) Inventors: Kyle R. Coston, Forney, TX (US); Justin W. Hollow Horn, Garland, TX (US); Stephen L. Uhrik, Richardson, TX (US); George A. Nelle, Plano, TX (US); Konstantin I. Khenokh, Plano, TX (US); Christopher Crisafulli, Mansfield, TX (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 738 days.

(21) Appl. No.: 17/420,546

(22) PCT Filed: Jan. 22, 2020

(86) PCT No.: PCT/US2020/014547
§ 371 (c)(1),
(2) Date: Jul. 2, 2021

(87) PCT Pub. No.: WO2020/154361
PCT Pub. Date: Jul. 30, 2020

(65) Prior Publication Data

US 2022/0105967 A1 Apr. 7, 2022

Related U.S. Application Data

(60) Provisional application No. 62/795,882, filed on Jan. 23, 2019.

(51) Int. Cl.
*B61D 17/10* (2006.01)

(52) U.S. Cl.
CPC ..... *B61D 17/10* (2013.01)

(58) Field of Classification Search
CPC ..... B61D 17/10; B61D 17/08
See application file for complete search history.

(56) References Cited

U.S. PATENT DOCUMENTS 2,183,054 A 12/1939 Tesseyman et al.
2,717,802 A * 9/1955 Martin ..... B62D 53/061 296/184.1

(Continued)

OTHER PUBLICATIONS

International Preliminary Report on Patentability for PCT Patent Application No. PCT/US2020/014547, mailed Aug. 5, 2021; 9 pages.

(Continued)

*Primary Examiner* — Scott A Browne
(74) *Attorney, Agent, or Firm* — Baker Botts L.L.P.

(57) ABSTRACT

According to some embodiments, a railcar extension for extending the width of a railcar comprises: a top portion for attaching to a railcar support; a first side portion coupled to the top portion, the first side portion comprising two parallel transverse walls connected by a longitudinal wall all extending perpendicular from the top portion and the two transverse walls are for attaching to the railcar support; a second side portion coupled to the first side portion, the second side portion comprising two parallel transverse walls connected by a longitudinal wall all extending downward from the first side portion and the two transverse walls are for attaching to the railcar support, and wherein the second side portion pivots with respect to the first side portion to conform to the railcar support; and a bottom portion coupled to the second side portion, the bottom portion for attaching to the railcar support.

20 Claims, 16 Drawing Sheets

(56) References Cited

U.S. PATENT DOCUMENTS

| | | | | |
|---|---|---|---|---|
| 3,238,899 | A | 3/1966 | Gutridge et al. | |
| 4,015,858 | A * | 4/1977 | Love | B62D 53/067 296/184.1 |
| 4,311,322 | A * | 1/1982 | Verros | B62D 53/067 16/350 |
| 4,397,498 | A * | 8/1983 | Joynt | B62D 33/02 296/184.1 |
| 4,930,426 | A | 6/1990 | Saxton et al. | |
| 4,943,106 | A * | 7/1990 | Hunt | B60P 3/42 296/184.1 |
| 5,501,556 | A | 3/1996 | Butcher et al. | |
| 6,758,514 | B1 * | 7/2004 | Walkden | B62D 33/027 296/183.1 |
| 7,568,754 | B2 * | 8/2009 | Adams | B62D 25/2054 296/184.1 |
| 9,663,146 | B1 * | 5/2017 | Dierks | B62D 21/20 |
| 10,549,764 | B2 * | 2/2020 | Hirashima | B61C 17/00 |
| 11,292,495 | B2 * | 4/2022 | Brückler | B61F 1/08 |
| 2007/0101895 | A1 | 5/2007 | Forbes et al. | |
| 2010/0109381 | A1 * | 5/2010 | Plavetich | B60R 9/00 108/134 |
| 2013/0180428 | A1 * | 7/2013 | Klotz | B61D 17/00 296/26.15 |

OTHER PUBLICATIONS

Office Action issued by the Canadian Intellectual Property Office for Application No. 3,124,706—Jan. 30, 2024.

PCT International Search Report issued for International application No. PCT/US2020/014547—Apr. 16, 2020.

PCT Written Opinion of the International Searching Authority issued for International application No. PCT/US2020/014547—Apr. 16, 2020.

* cited by examiner

RAILCAR EXTENSIONS FOR INCREASED STRUCTURE WIDTH

PRIORITY

This nonprovisional application is a U.S. National Stage Filing under 35 U.S.C. § 371 of International Patent Application Serial No. PCT/US2020/014,547 filed Jan. 22, 2020 and entitled "Railcar Extensions for Increased Structure Width" which claims priority to U.S. Provisional Patent Application No. 62/795,882 filed Jan. 23, 2019 both of which are hereby incorporated by reference in their entirety.

TECHNICAL FIELD

Particular embodiments relate generally to railcars, and more particularly to extensions for increasing the structure width of railcars, such as flatcars, spine cars, autorack cars, etc.

BACKGROUND

Typical railcars generally have a fixed width along their length. Railcar width is constrained by American Association of Railroads (AAR) regulations. For example, the AAR regulations include clearance diagrams that specify maximum width and maximum height of a railcar at the center of the railcar and other locations along the length of the railcar.

Because of the AAR clearance limitations, designers often increase the cargo-carrying capacity of a railway car by increasing the length of the railway car. Unfortunately, as the length of a railway car increases, the width allowed by the AAR clearance limitations decrease to account for the travel of a railway car around a curve. While traveling around a curve, a portion of a railway car may extend outside a clearance plane specified by AAR limitations, which is not acceptable. Therefore, a stricter width clearance limitation is applied to longer railcars to prevent, for example, the railcar from contacting a structure adjacent the railroad.

Thus, the AAR clearance limitations generally limit the width-to-length ratio for constructing a railcar, which restricts the cargo-carrying capability of a railcar. The amount of cargo a railcar may carry is important because it directly impacts the profitability of a railway carrier. Thus, maximizing railcar cargo carrying capacity while staying within AAR clearance limitations is desirable.

SUMMARY

According to some embodiments, a railcar extension adapted to extend the width of a railcar comprises a top portion comprising a plate for attaching to a top horizontal surface of a railcar support and a first side portion loosely coupled to the top portion. The first side portion comprises two parallel transverse walls connected by a longitudinal wall forming an open chamber between the walls. The two transverse walls and the longitudinal wall extend perpendicular from the top portion and the two transverse walls are for attaching to a non-horizontal surface of the railcar support. The railcar extension further comprises a second side portion loosely coupled within the open chamber of the first side portion. The second side portion comprises two parallel transverse walls connected by a longitudinal wall. The two transverse walls and the longitudinal wall extend at a downward angle from the first side portion and the two transverse walls are for attaching to the non-horizontal surface of the railcar support. The second side portion pivots within the open chamber of the first side portion to conform to the non-horizontal surface of the railcar support. The railcar extension further comprises a bottom portion loosely coupled to the second side portion. The bottom portion comprises a plate for attaching to a bottom horizontal surface of the railcar support.

In particular embodiments, the railcar support comprises a side sill, the top portion is for attaching to a top of the side sill, the first side portion and the second side portion are for attaching to a side of the side sill, and the bottom portion is for attaching to a bottom of the side sill. The railcar extension top portion may couple to a post pad on the side sill.

In particular embodiments, the railcar support comprises a spine car cross member support, the top portion is for attaching to a top end of the cross member support, the first side portion and the second side portion are for attaching to an end of the cross member support, and the bottom portion is for attaching to a bottom end of the cross member support.

In particular embodiments, the depth of the railcar extension is based on a longitudinal position of the railcar extension on the railcar and the American Association of Railroads (AAR) clearance envelope at the longitudinal position on the railcar.

In particular embodiments, the top portion and the first side portion are wider than the second side portion and the bottom portion. The second side portion and the bottom portion may be centered with respect to the top portion and the first side portion. The second side portion and the bottom portion may be offset with respect to the top portion and the first side portion to avoid obstructions on the railcar support.

According to some embodiments, a railcar comprises a plurality of railcar extensions. Each railcar extension of the plurality of railcar extensions comprises a top portion comprising a plate coupled to a top horizontal surface of a railcar support and a first side portion coupled to the top portion. The first side portion comprises two parallel transverse walls connected by a longitudinal wall forming an open chamber between the walls. The two transverse walls and the longitudinal wall extend perpendicular from the top portion and the two transverse walls are coupled to a non-horizontal surface of the railcar support. Each railcar extension further comprises a second side portion coupled to the first side portion. The second side portion comprising two parallel transverse walls connected by a longitudinal wall. The two transverse walls and the longitudinal wall extend at a downward angle from the first side portion and the two transverse walls are coupled to the non-horizontal surface of the railcar support. Each railcar extension further comprises a bottom portion coupled to the second side portion. The bottom portion comprises a plate coupled to a bottom horizontal surface of the railcar support.

In particular embodiments, the railcar support comprises a side sill, each top portion is coupled to a top of the side sill, each of the first side portions and the second side portions are coupled to a side of the side sill, and each of the bottom portions is coupled to a bottom of the side sill. Each railcar extension top portion may couple to a post pad on the side sill. The railcar may comprise an autorack railcar comprising a plurality of side posts, and each side post of the plurality of side posts may be coupled to a railcar extension of the plurality of railcar extensions.

In particular embodiments, the railcar comprises a flatcar, and each railcar extension of the plurality of railcar extensions supports an extended width floor.

In particular embodiments, the railcar support comprises a spine car cross member support, each of the top portions is coupled to a top end of the cross member support, each of the first side portions and the second side portions are coupled to an end of the cross member support, and each of the bottom portions is coupled to a bottom end of the cross member support.

In particular embodiments, the depth of each railcar extension of the plurality of railcar extensions is based on a longitudinal position of the railcar extension on the railcar and the American Association of Railroads (AAR) clearance envelope at the longitudinal position on the railcar.

In particular embodiments, the top portion and the first side portion are wider than the second side portion and the bottom portion. The second side portion and the bottom portion of at least one railcar extension may be offset with respect to the top portion and the first side portion to avoid obstructions on the railcar support.

According to some embodiments, a method for extending the width of a railcar comprises coupling a top portion of a railcar extension to a top horizontal surface of a railcar support and coupling a first side portion of the railcar extension to the top portion of the railcar extension. The first side portion comprises two parallel transverse walls connected by a longitudinal wall forming an open chamber between the walls. The two transverse walls and the longitudinal wall extend perpendicular from the top portion. The method further comprises coupling the two transverse walls of the first side portion to a non-horizontal surface of the railcar support and aligning a second side portion of the railcar extension to conform to the non-horizontal surface of the railcar support. The second side portion comprises two parallel transverse walls connected by a longitudinal wall. The two transverse walls and the longitudinal wall extend at a downward angle from the first side portion. The method further comprises: coupling the second side portion of the railcar extension to the first side portion; coupling the two transverse walls of the second side portion to the non-horizontal surface of the railcar support; and coupling a bottom portion of the railcar extension to the second side portion. The bottom portion comprises a plate. The method further comprising coupling the bottom portion to a bottom horizontal surface of the railcar support.

In particular embodiments, the method further comprises coupling a side post to the top portion of the railcar extension or coupling extended width flooring to the top portion of the railcar extension.

BRIEF DESCRIPTION OF THE DRAWINGS

A more complete and thorough understanding of the particular embodiments and advantages thereof may be acquired by referring to the following description taken in conjunction with the accompanying drawings, in which like reference numbers indicate like features, and wherein.

DETAILED DESCRIPTION

Typical railcars generally have a fixed width along their length. American Association of Railroads (AAR) regulations include clearance diagrams that specify maximum width and maximum height of a railcar at the center of the railcar and other locations along the length of the railcar. Particular embodiments described herein take advantage of the variable width requirements by increasing existing railcar widths at particular locations to increase the railcar loading space.

In particular embodiments, one or more railcar extensions are coupled (e.g., bolted, welded, etc.) to an existing railcar structure varying the width of the railcar along its length. A railcar with the railcar extensions may use the full extents of the AAR clearances and curving restrictions, which maximizes the railcar cargo carrying capacity.

The railcar extensions may couple to various types of railcars, such as flatcars, spine cars, box cars, autorack cars, etc. For cars with side sills, such as flatcars, box cars, and autorack cars, the railcar extensions may be coupled to the side sills. For other cars, such as spine cars, the railcar extensions may be coupled to cross members.

A particular advantage of an increased width flatcar or spine car is that the increased surface area may be used to load additional cargo, or to provide additional room for loading personnel to load and access the cargo. Similarly, increased width for an autorack car provides greater clearances within the autorack car for personnel to load vehicles, access the vehicle (e.g., opening vehicle doors while loaded), and chock the vehicle wheels. The additional width may also be used as storage for loading securements, storage for lading, and/or storage for vehicles accessories (e.g., keys, batteries, lock boxes, etc.).

In general, increased railcar width may accommodate safer and easier: loading and unloading of lading, personnel access such as movement around lading or access to lading, and storage of securements and/or commodity accessories. In addition, the extra width may reduce lading damage (e.g., lading contacting sidewalls) during loading, securement, transportation, and unloading.

Particular embodiments are described more fully with reference to the accompanying drawings. Other embodiments, however, are contained within the scope of the subject matter disclosed herein. The disclosed subject matter should not be construed as limited to only the embodiments set forth herein; rather, these embodiments are provided by way of example to convey the scope of the subject matter to those skilled in the art.

Figure 1:
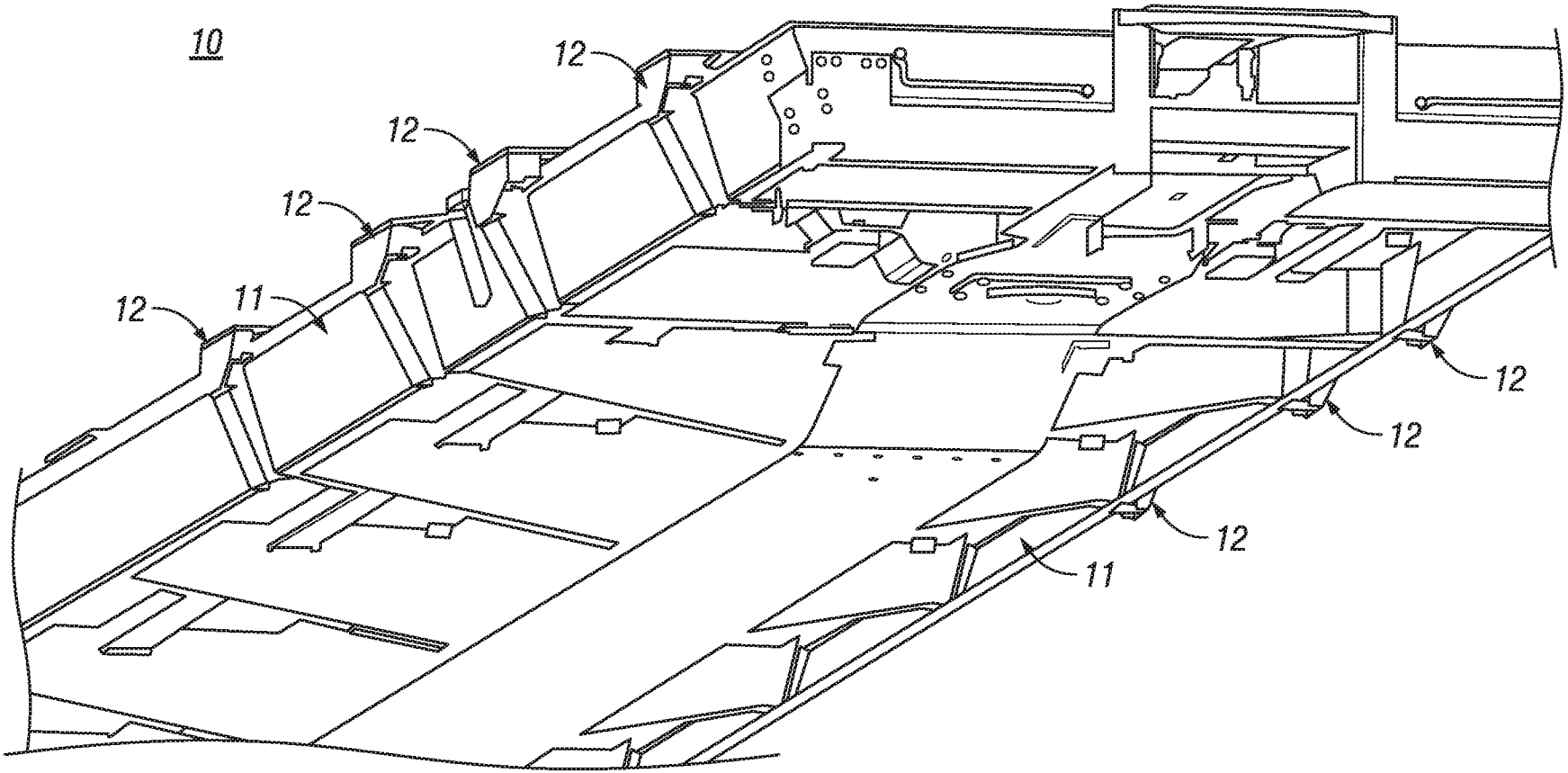
FIG. 1 is a schematic perspective of the underside of an example flatcar, according to some embodiments.

FIG. 1 is a schematic perspective of the underside of an example flatcar, according to some embodiments. Flatcar 10 includes two side sills 11. Side sills 11 are generally parallel and equidistant apart along the length of flatcar 10.

One or more railcar extensions 12 are coupled (e.g., bolted, welded, etc.) to side sills 11 along the length of railcar 10. Railcar extension 12 extends the width of railcar 10 by providing support for a wider deck on a flat car for example, or support for side wall posts of an autorack car. The amount of extension each railcar extensions provides may vary. For example, wider railcar extensions may be used near the ends of railcar 10 and narrower railcar extensions may be used near the center of railcar 10.

The particular width of any railcar extension 12 along the length of railcar 10 may be determined by the AAR clearance envelope. Examples are illustrated in FIGS. 2 and 3.

Figure 2:
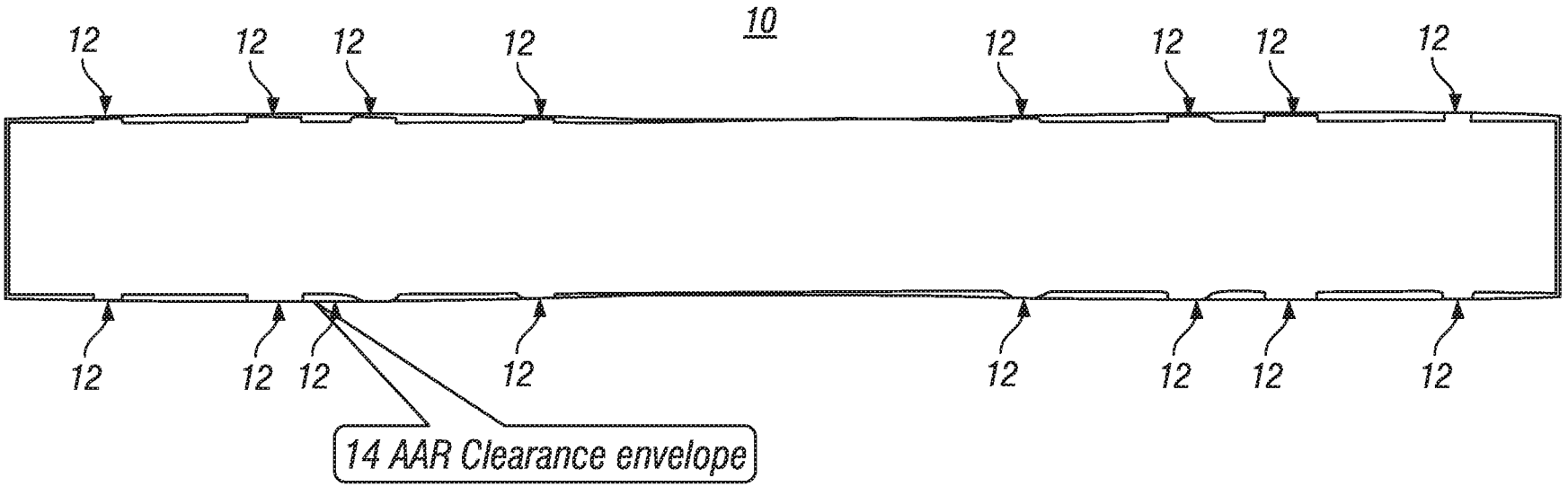
FIG. 2 is a plan view of an example flatcar within an American Association of Railroads (AAR) clearance envelope, according to some embodiments.

FIG. 2 is a plan view of an example flatcar, according to some embodiments. AAR clearance envelope 14 is represented by the solid border surrounding railcar 10. Railcar extensions 12 vary in width within AAR clearance envelope 14.

Figure 3:
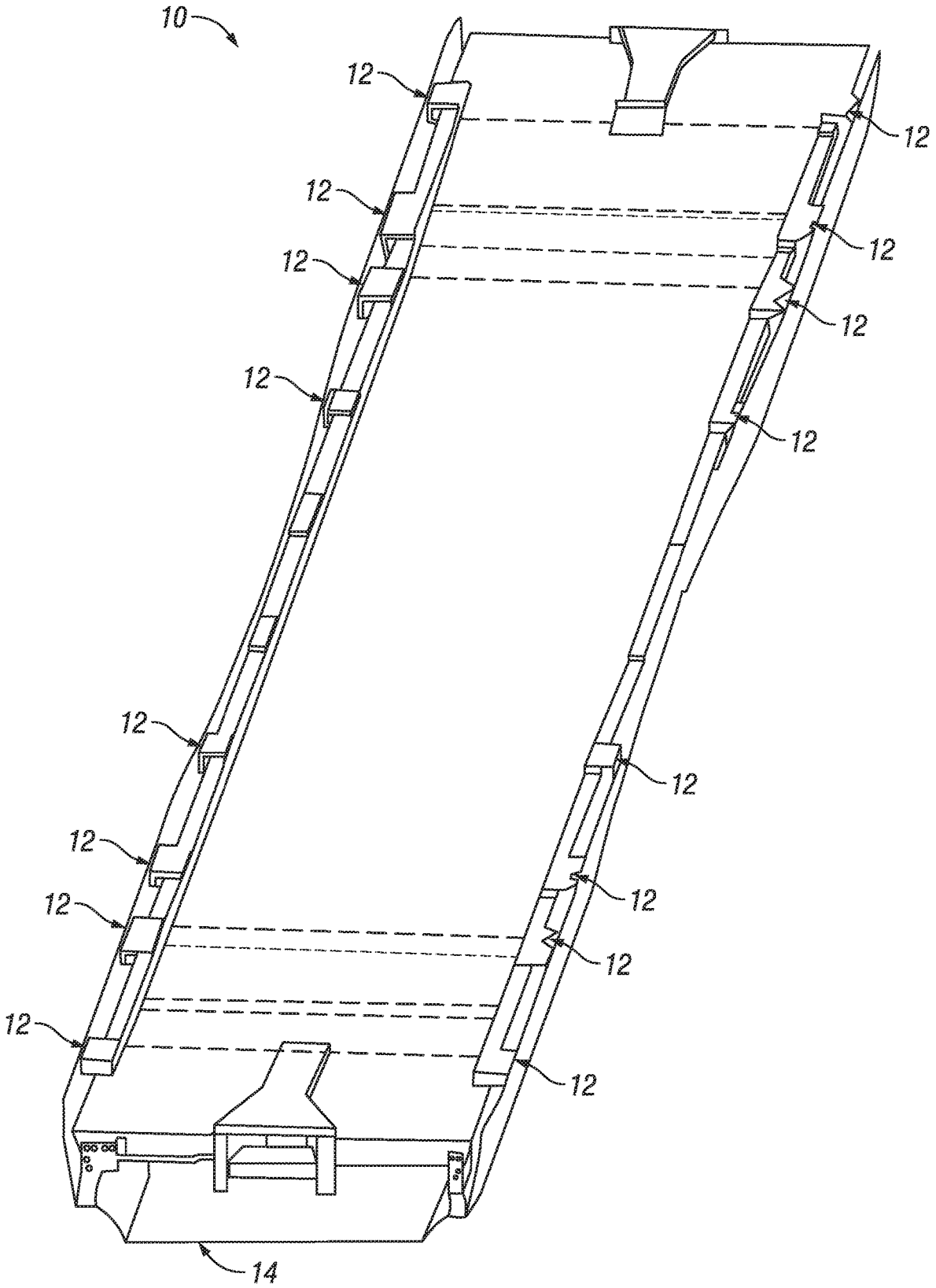
FIG. 3 is a schematic perspective of an example flatcar within an AAR clearance envelope.

FIG. 3 is a schematic perspective of an example flatcar within an AAR clearance envelope. Railcar 10 is the same flatcar illustrated in FIGS. 1-2. Various examples of railcar extension 12 are illustrated in more detail in FIGS. 4-12.

Figure 4:
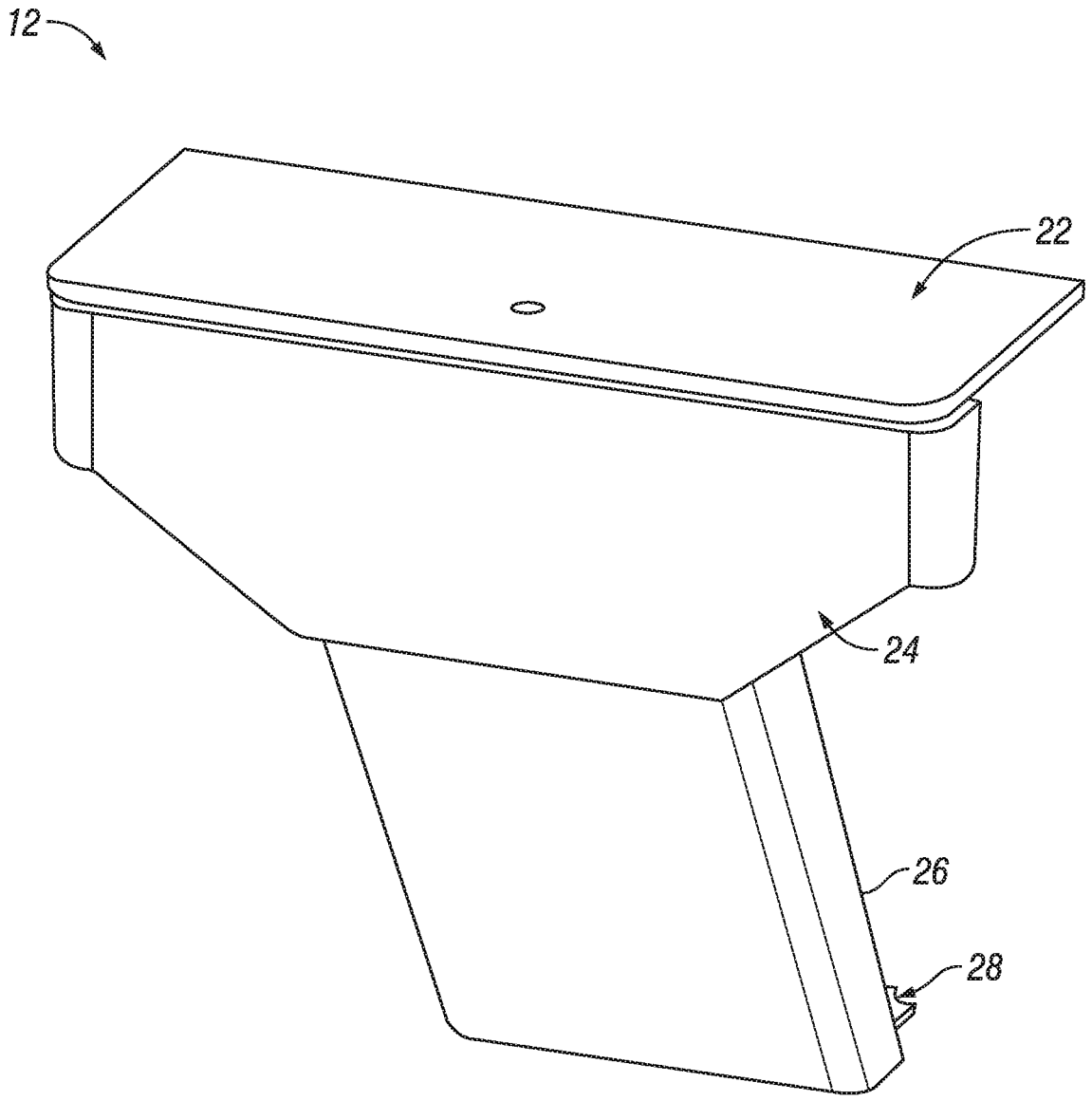
FIG. 4 is a perspective schematic illustrating a railcar extension, according to a particular embodiment.

FIG. 4 is a perspective schematic illustrating a railcar extension, according to a particular embodiment. Railcar extension 12 includes top portion 22, first side portion 24, second side portion 26, and bottom portion 28.

The top portion comprises a plate for attaching to a top horizontal surface of a railcar support. For example, top portion 22 couples to the top of the side sill and provides support for extended width decking or side wall support posts.

The first side portion is loosely coupled to the top portion. The first side portion comprises two parallel transverse walls connected by a longitudinal wall forming an open chamber between the walls. The two transverse walls and the longitudinal wall extend perpendicular from the top portion and the two transverse walls are for attaching to a non-horizontal surface of the railcar support. For example, first side portion 24 is loosely coupled to top portion 22.

The second side portion is loosely coupled within the open chamber of the first side portion. The second side portion comprises two parallel transverse walls connected by a longitudinal wall. The two transverse walls and the longitudinal wall extend at a downward angle from the first side portion and the two transverse walls are for attaching to the non-horizontal surface of the railcar support. The second side portion pivots within the open chamber of the first side portion to conform to the non-horizontal surface of the railcar support. For example, second side portion 26 is loosely coupled to first side portion 24.

The bottom portion is loosely coupled to the second side portion. The bottom portion comprises a plate for attaching to a bottom horizontal surface of the railcar support. For example, bottom portion 28 couples to second side portion 26.

The amount of extension provided by railcar extension 12 is determined at least in part by the width of top portion 22 and possibly bottom portion 28. The amount of extension may be based on the AAR clearance envelope described above. The heights of first side portion 24 and second side portion 26 depend at least in part on the height of the side sill.

Side sills of railcars from different manufactures, or side sills for different types of railcars from the same manufacturer, may vary in dimension. Furthermore, the various forces and stresses applied to a railcar during transportation may introduce minor deviations between a side sill of one railcar and a side sill of another railcar. In particular embodiments, railcar extension 12 may accommodate the side sill variations.

In particular embodiments, top portion 22, first side portion 24, second side portion 26, and bottom portion 28 may comprise slip-fit components. For example, the component may be loosely coupled (permitting movement of one component with respect to another) or not coupled at all. The slip-fit components permit slip-fit assembly where the coupling points of railcar extension 12 may be adjusted (e.g., angles of attachment, width and height between components, etc.) to a particular side sill before attached to the side sill. For example, the angle between first side portion 24 and second side portion 26 may be adjusted to match an existing side sill. Accordingly, railcar extension 12 may be quickly and easily attached to a variety of side sills, which is an advantage when retrofitting existing railcars.

Although particular advantages of railcar extension 12 are described above with respect to a side sill, similar advantages exist for railcar extension 12 coupled to a cross member support of a spine car where various cross members may vary in dimension or orientation. An example of another railcar extension 12 is illustrated in FIGS. 5A and 5B.

Figure 5A:
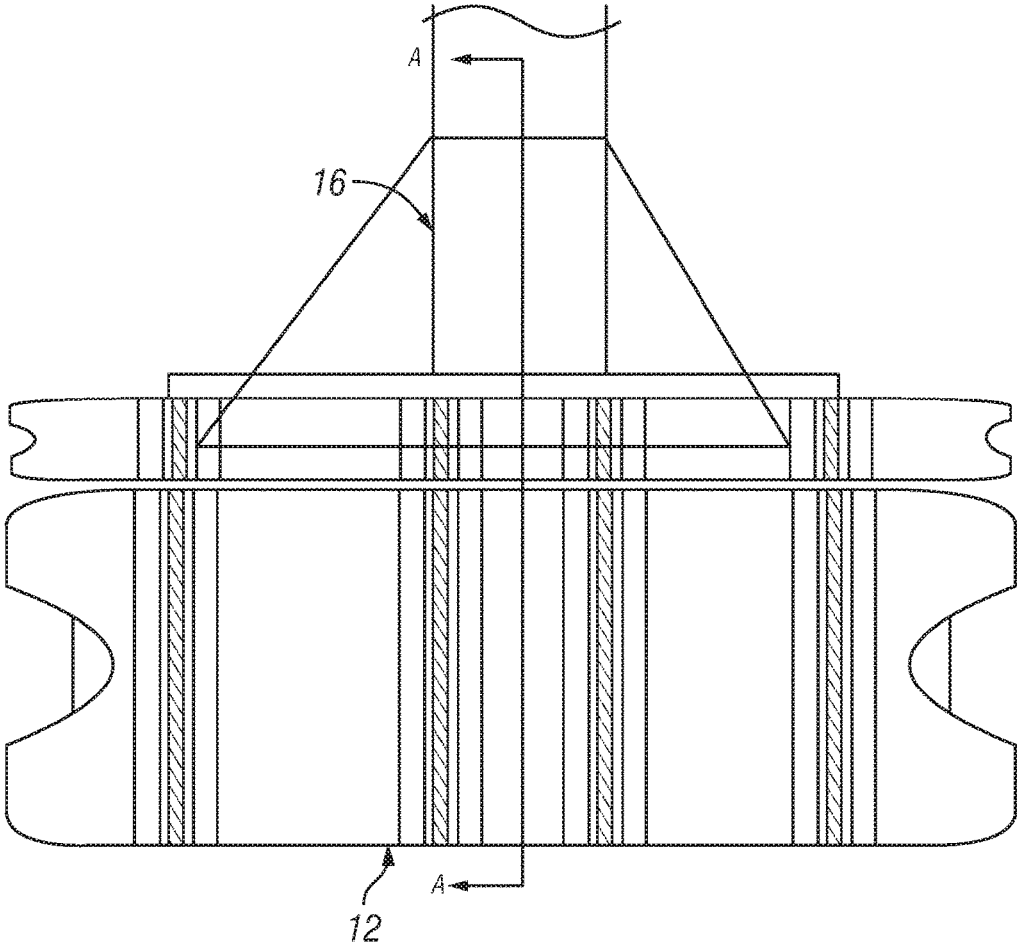
FIG. 5A is a schematic side view of another railcar extension, according to a particular embodiment.
Figure 5B:
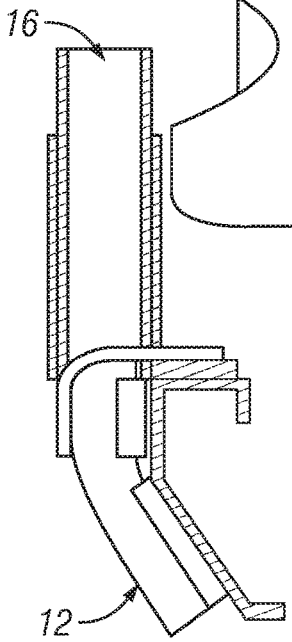
FIG. 5B is a cross section of the example railcar extension illustrated in FIG. 5A.

FIG. 5A is a schematic side view of another railcar extension, according to a particular embodiment. FIG. 5B is a cross section of the example railcar extension illustrated in FIG. 5A. In the illustrated example railcar extension 12 supports side post 16. An example of another railcar extension 12 is illustrated in FIGS. 6A and 6B.

Figure 6A:
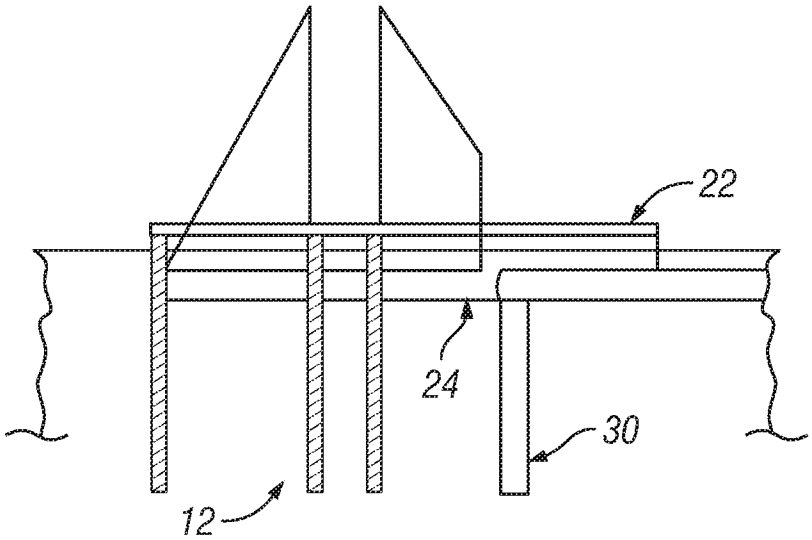
FIG. 6A is a schematic side view of another railcar extension, according to a particular embodiment.
Figure 6B:
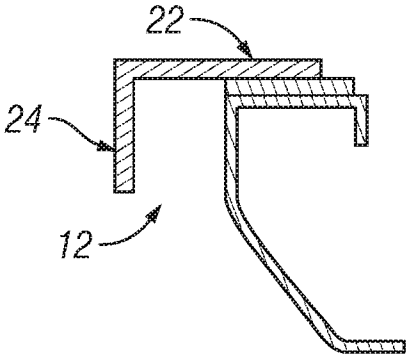
FIG. 6B is a cross section of the example railcar extension illustrated in FIG. 6A.

FIG. 6A is a schematic side view of another railcar extension, according to a particular embodiment. FIG. 6B is a cross section of the example railcar extension illustrated in FIG. 6A. In particular embodiments, railcar extension 12 may be modified to accommodate various obstructions attached to the side sill, such as brackets, supports, coupling points, etc.

For example, in FIG. 4 the top portion and the first side portion are wider than the second side portion and the bottom portion. The second side portion and the bottom portion are centered with respect to the top portion and the first side portion. In FIGS. 6A and 6B second side portion and the bottom portion are offset with respect to the top portion and the first side portion to avoid obstructions on the railcar support.

For example, in FIG. 6A the side sill includes jack platform 30. To position railcar extension 12 near jack platform 30, the right portion of top portion 22 and first side portion 24 extends out further from second side portion 26 than the left portion of top portion 22 and first side portion 24. Accordingly, second side portion 26 may be coupled to the side sill without interference from jack platform 30.

Figure 7C:
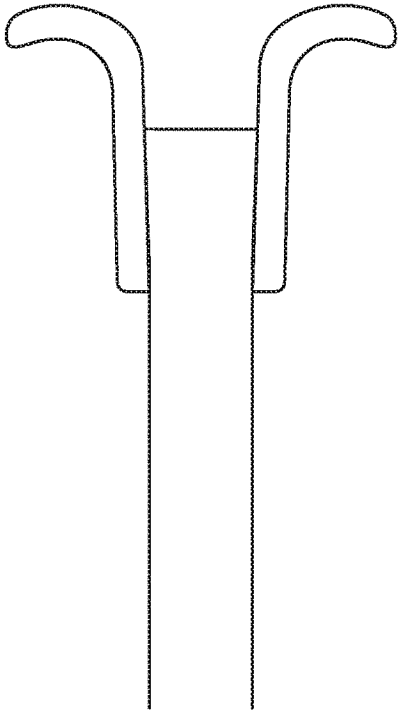
FIGS. 7A-7C are schematic cross-sectional views of another railcar extension, according to some embodiments.
Figure 7B:
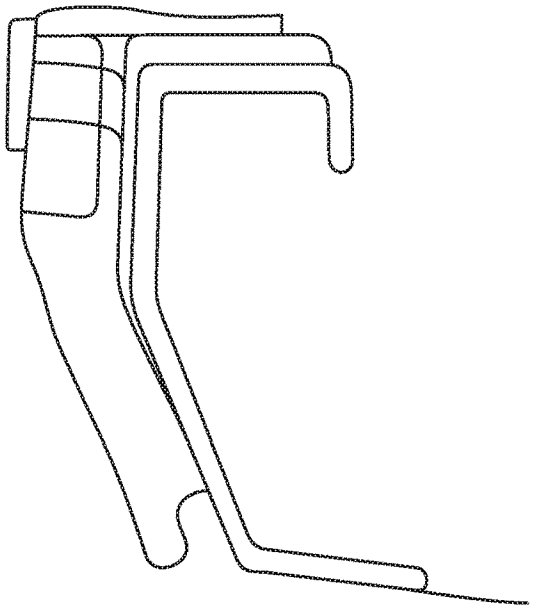
Figure 7A:
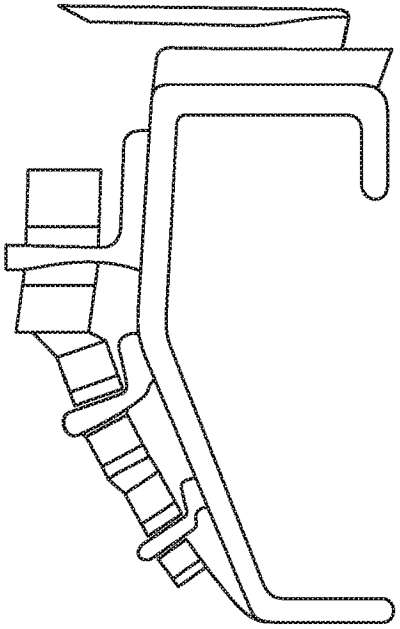
Figure 8C:
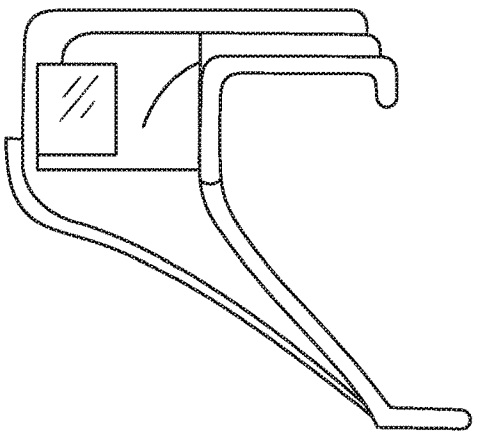
FIGS. 8A-8J are schematic cross-sectional views of several example railcar extensions, according to various embodiments.
Figure 8E:
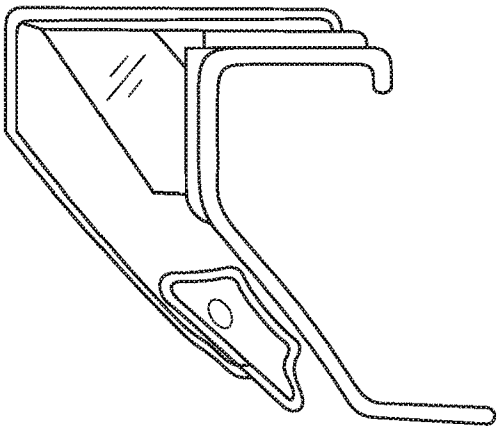
Figure 8B:
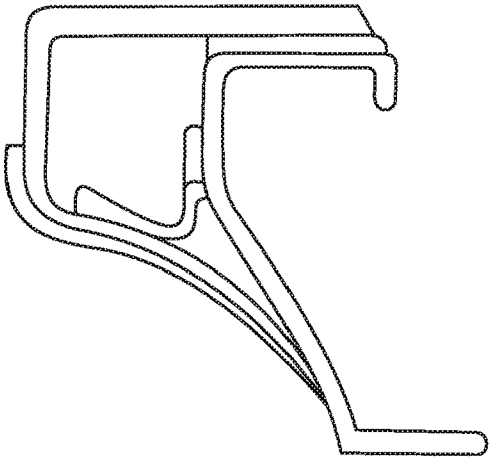
Figure 8D:
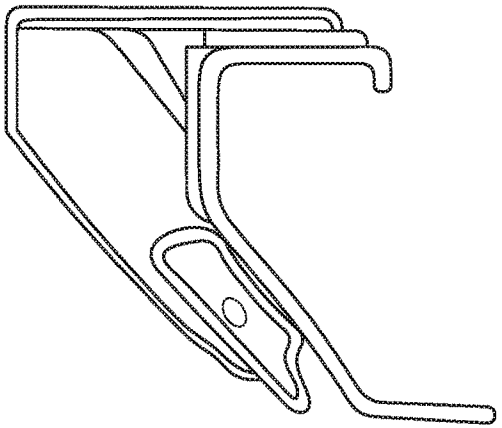
Figure 8A:
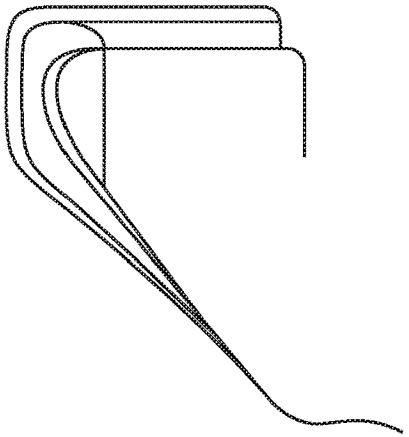
Figure 8H:
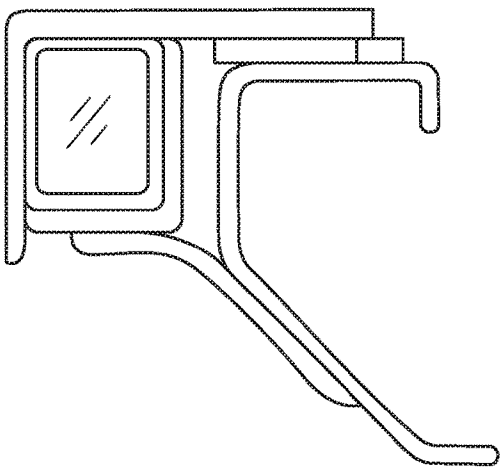
Figure 8J:
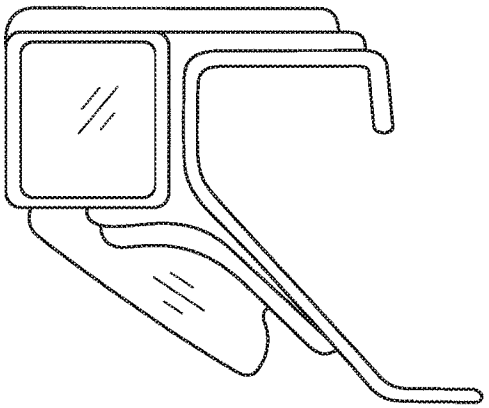
Figure 8G:
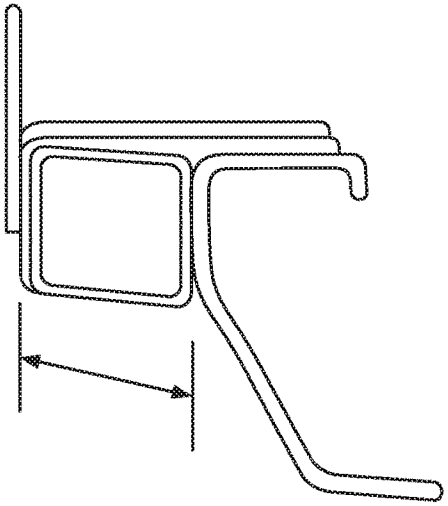
Figure 8F:
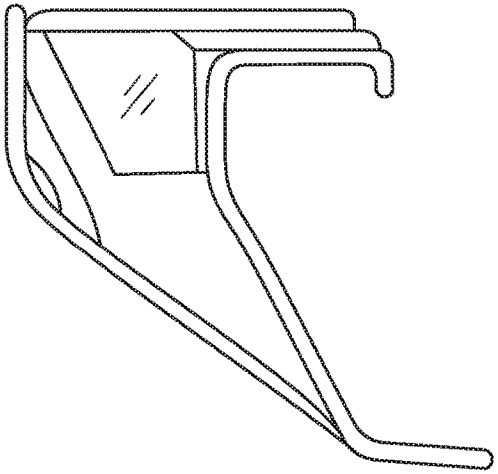
Figure 8I:
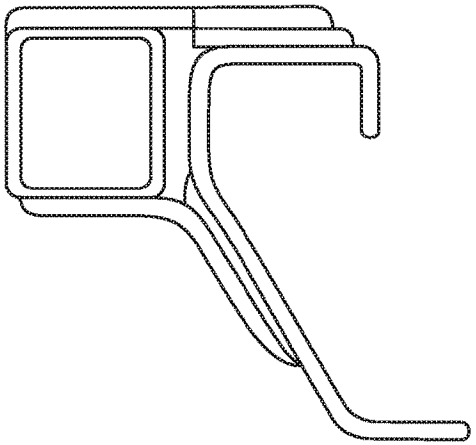
Figure 9A:
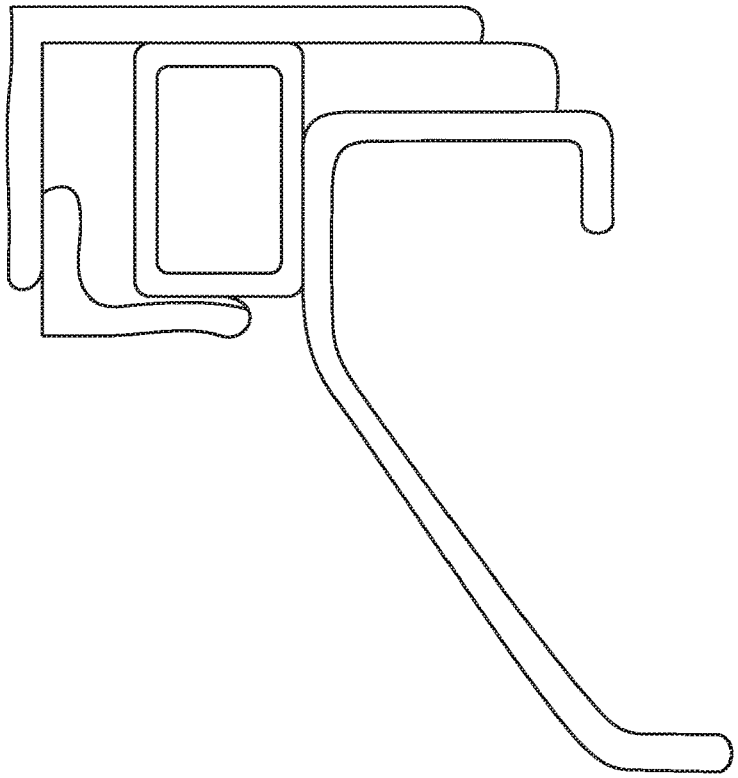
FIGS. 9A-9D are schematic cross-sectional views of example railcar extensions using square or rectangular tubing, according to various embodiments.
Figure 9B:
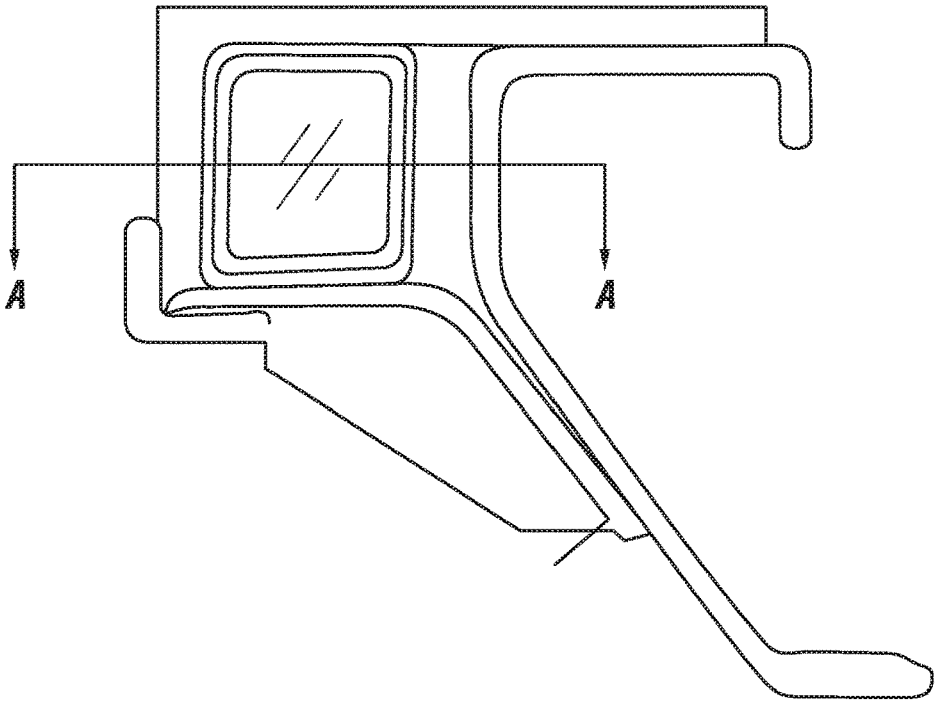
Figure 9C:
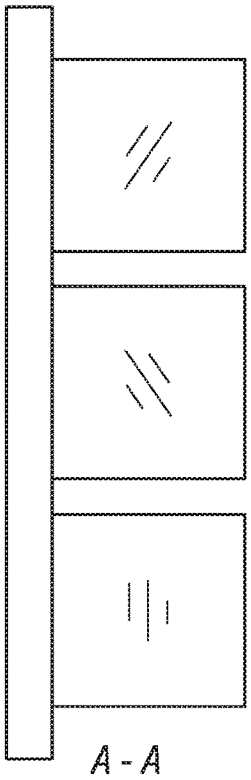
Figure 9D:
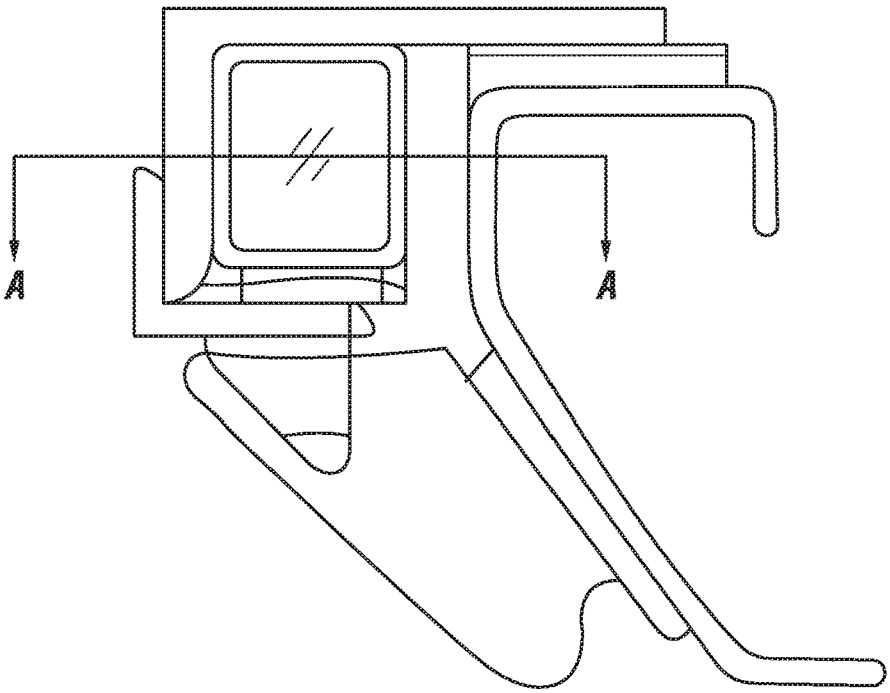

FIGS. 7A-7C are schematic cross-sectional views of another railcar extension, according to some embodiments. FIGS. 8A-8J are a schematic cross-sectional views of several example railcar extensions, according to various embodiments. FIGS. 9A-9D are schematic cross-sectional views of example railcar extensions using square or rectangular tubing, according to various embodiments.

Figure 10:
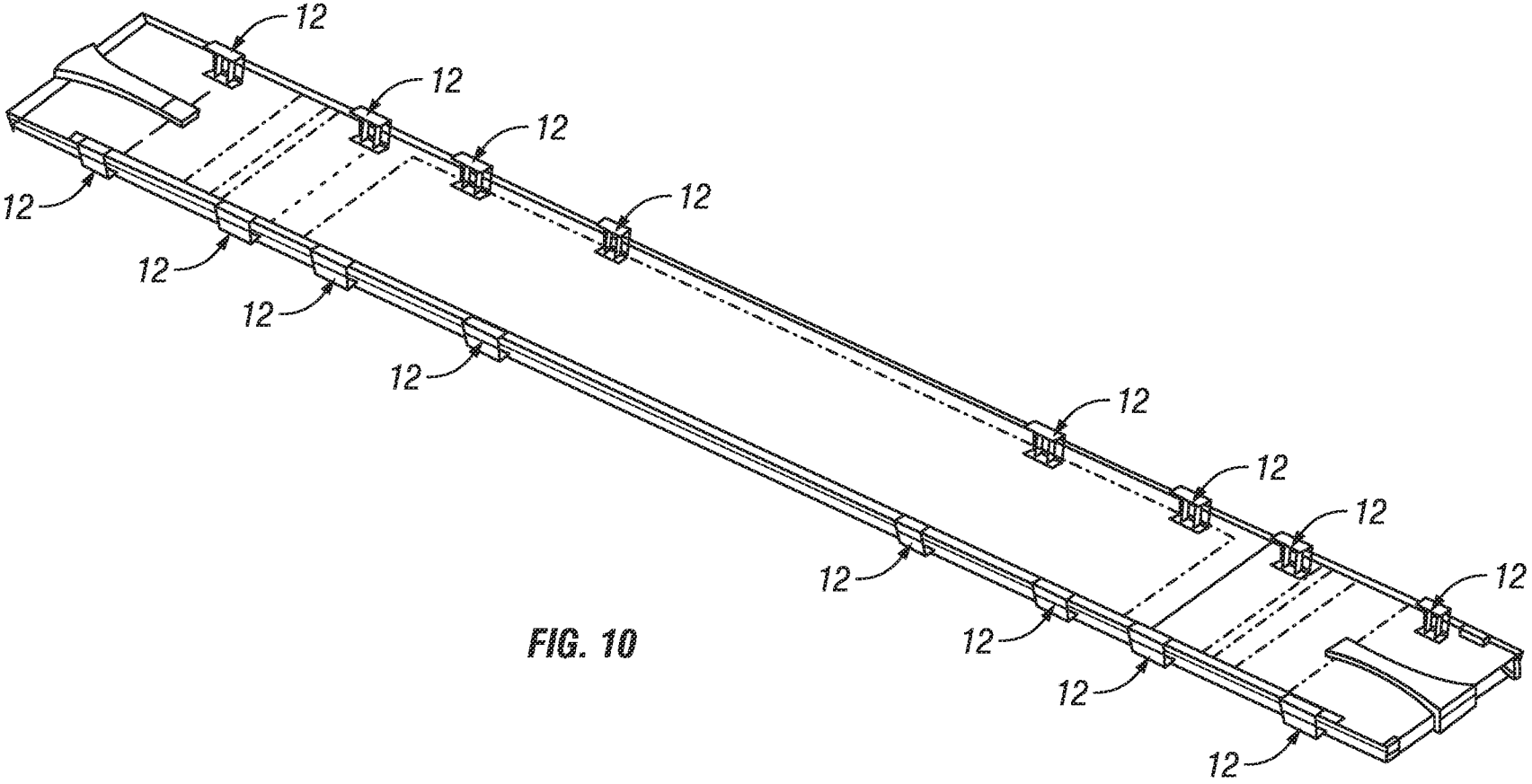
FIG. 10 is a perspective schematic illustrating example railcar extensions on a flatcar.

FIG. 10 is a perspective schematic illustrating example railcar extensions on a flatcar. In the illustrated example, the side sills are transparent to illustrate how railcar extensions 12 wrap around the edge of the side sill.

FIGS. 11A-11D are perspective and schematic cross-sectional views of a railcar extension first side portion, according to a particular embodiment. The railcar extension first side portion is similar to railcar extension first side portion 24 illustrated in FIG. 4.

Figure 11A:
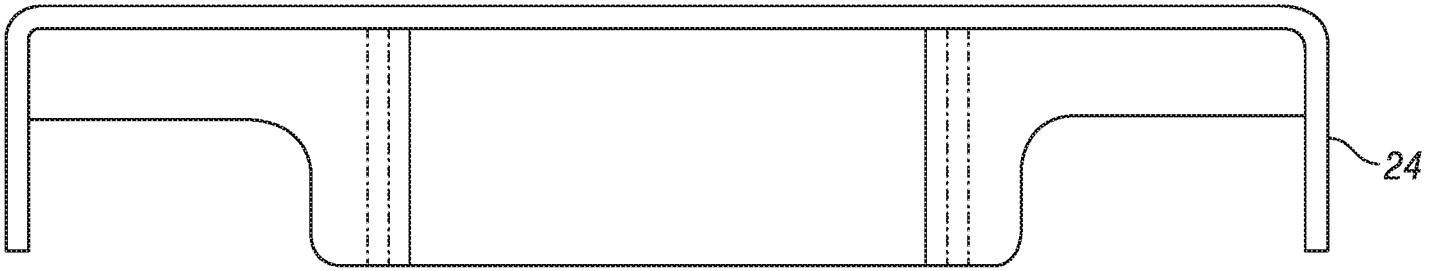
FIGS. 11A-11D are perspective and schematic cross-sectional views of a railcar extension first side portion, according to a particular embodiment.

FIG. 11A is a plan view schematic of railcar extension first side portion 24, illustrating the transverse walls and longitudinal wall of railcar extension first side portion 24. The transverse walls are the walls that are parallel to the transverse axis of the railcar, and the longitudinal wall is the wall parallel to the longitudinal axis of the railcar.

Figure 11B:
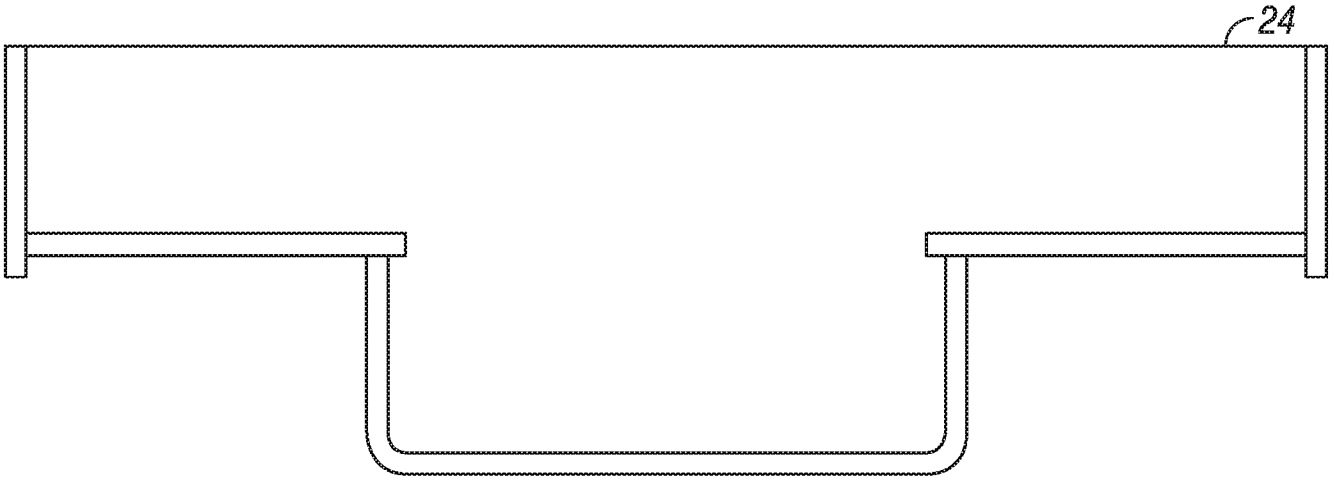

FIG. 11B is a side schematic view of the interior of railcar extension first side portion 24. The open chamber between the transverse walls and longitudinal wall is illustrated.

Figure 11C:
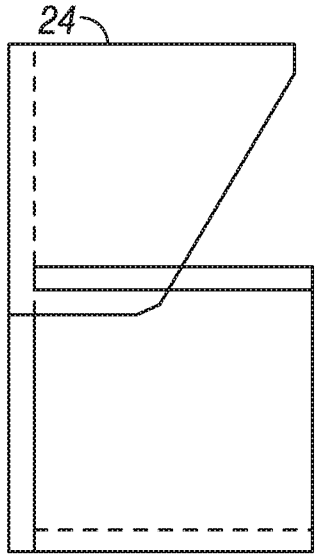
Figure 11D:
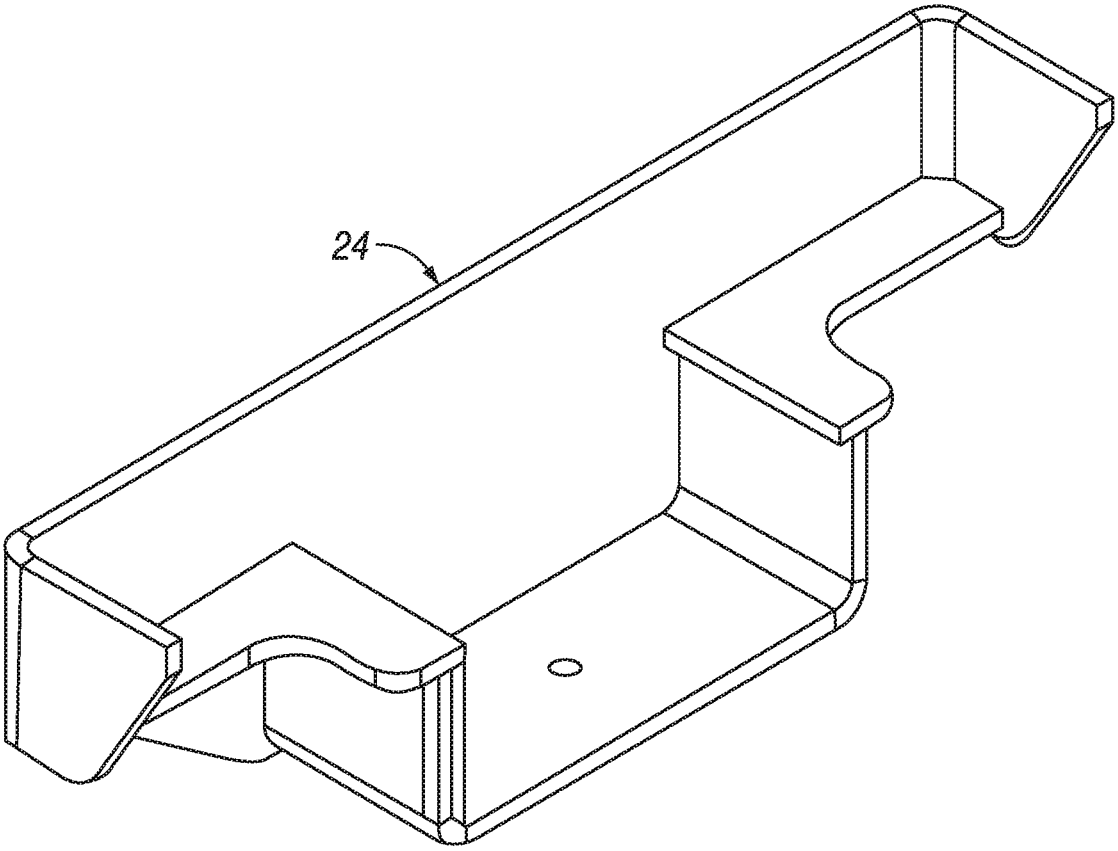

FIG. 11C is an edge schematic view of an outside edge of railcar extension first side portion 24. FIG. 11D is a perspective schematic view of railcar extension first side portion 24.

Figure 12:
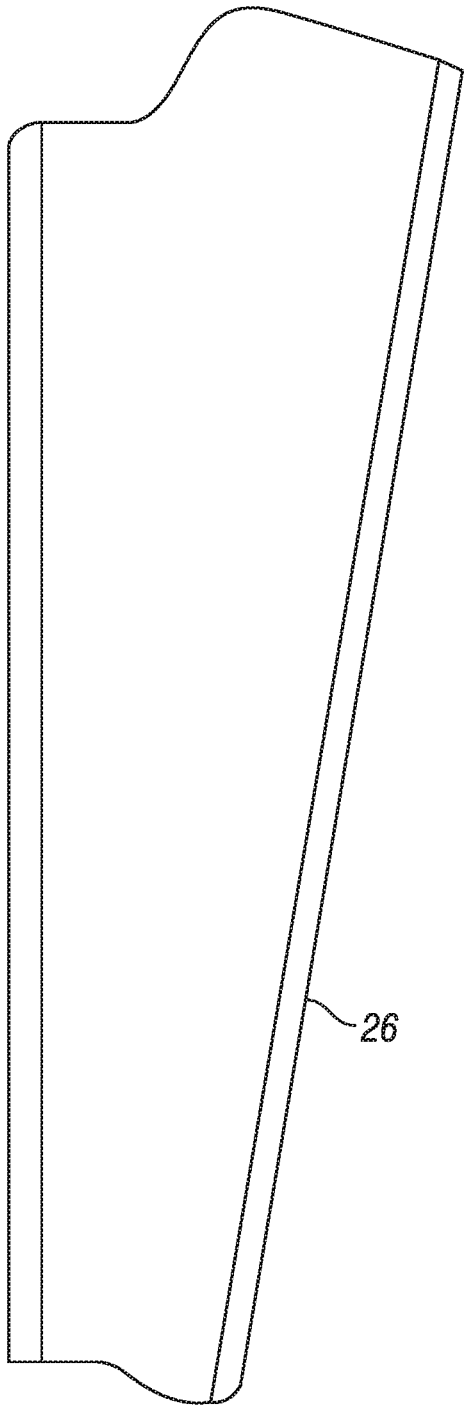
FIG. 12 is a schematic side view of a railcar extension second side portion, according to a particular embodiment.

FIG. 12 is a schematic side view of a railcar extension second side portion, according to a particular embodiment. As illustrated in FIG. 4, railcar extension second side portion 26 is loosely coupled to first side portion 24. The curves in the top of second side portion 26 facilitate second side portion 26 to pivot with respect to first side portion 24 so that second side portion 26 can conform to the edge of side sill 11.

Figure 13:
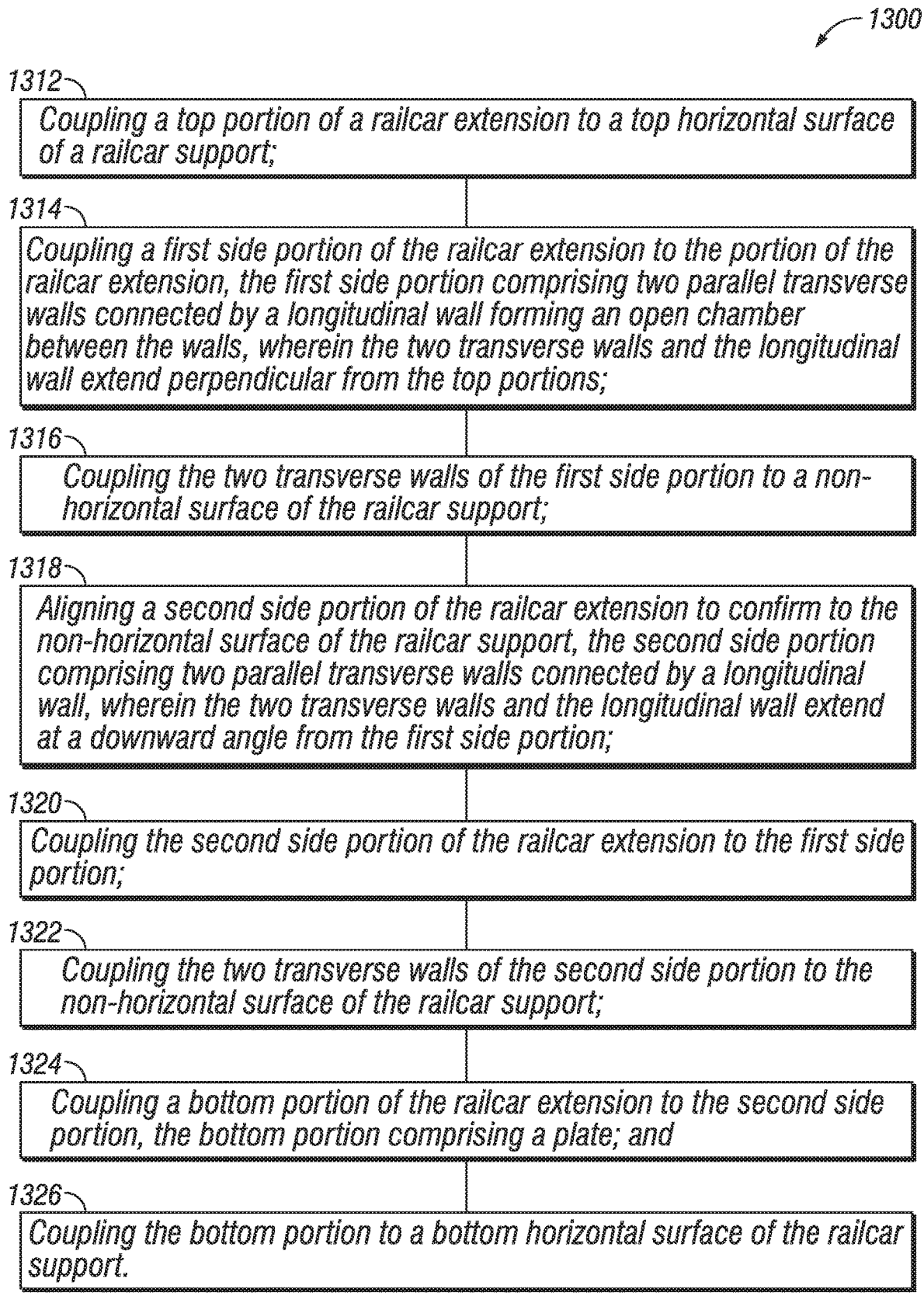
FIG. 13 is a flow diagram illustrating an example method of extending the width of a railcar.

FIG. 13 is a flow diagram illustrating an example method of extending the width of a railcar. The steps of method 1300 may be performed with respect to railcar extension 12 and railcar 10 illustrated in FIG. 1-12. The method may be performed by a railcar technician. The technician may physically perform particular steps such as coupling and aligning (e.g., operating a welding machine), or the technician may cause the steps to be performed (e.g., controlling a robotic welding machine, or programming a robotic welding machine). Although a technician performs the steps in the example method 1300, in other embodiments the steps may be performed by a machine.

The method begins at step 1312, where a technician couples a top portion of a railcar extension to a top horizontal surface of a railcar support. For example, railcar extension top portion 22 may be coupled to the top of a side sill or cross member support of railcar 10. The railcar may comprise a flatcar, spine car, box car, autorack car, etc.

At step 1314, the technician couples a first side portion of the railcar extension to the top portion of the railcar extension. The first side portion comprises two parallel transverse walls connected by a longitudinal wall forming an open chamber between the walls. The two transverse walls and the longitudinal wall extend perpendicular from the top portion. For example, railcar extension first side portion 24 may be coupled to railcar extension top portion 22.

At step 1316, the technician couples the two transverse walls of the first side portion to a non-horizontal surface of the railcar support. For example, railcar extension first side portion 24 may be coupled to the side of a side sill or cross member support of railcar 10.

At step 1318, the technician aligns a second side portion of the railcar extension to conform to the non-horizontal surface of the railcar support. The second side portion comprises two parallel transverse walls connected by a longitudinal wall. The two transverse walls and the longitudinal wall extend at a downward angle from the first side portion.

The non-horizontal surface of the railcar support refers to the vertical edge of the railcar support. However, the vertical edge of the railcar support (e.g., side sill) may be not be at ninety degrees to the horizontal edges (i.e., top and bottom) of the railcar support either by design or through fatigue. For this reason, the second side portion is loosely coupled to the first side portion and is thus able to be aligned with the side of the railcar support.

At step 1320, the technician couples the second side portion of the railcar extension to the first side portion, and at step 1322, the technician couples the two transverse walls of the second side portion to the non-horizontal surface of the railcar support. For example, second side portion 26 may be coupled to first side portion 24 and the side sill or cross member support of railcar 10.

At step 1324, the technician couples a bottom portion of the railcar extension to the second side portion. The bottom portion comprises a plate.

At step 1326, the technician couples the bottom portion to a bottom horizontal surface of the railcar support. For example, bottom portion 28 may be coupled to second side portion 26 and a bottom of the side sill or cross member support of railcar 10.

Modifications, additions, or omissions may be made to the method illustrated in FIG. 13. Additionally, one or more steps in the method may be performed in parallel or in any suitable order. For example, in the example method the railcar extension components are coupled to the railcar in a top down manner. In other embodiments, the railcar extension components may be coupled to the railcar in a top up manner, or any suitable order.

Although particular embodiments are illustrated in FIGS. 1-13, particular components of one example embodiments may be combined with any other embodiment. In addition, although the embodiments above are described with respect to a flat car, the embodiments may apply to other railcars, such as spine cars, box cars, autorack cars, etc.

Although particular embodiments and their advantages have been described in detail, it should be understood that various changes, substitutions and alternations can be made herein without departing from the scope of the embodiments.

The invention claimed is:

1. A railcar extension adapted to extend the width of a railcar, the railcar extension comprising:

a top portion comprising a plate for attaching to a top horizontal surface of a railcar support;

a first side portion loosely coupled to the top portion, the first side portion comprising two parallel transverse walls connected by a longitudinal wall forming an open chamber between the walls, wherein the two transverse walls and the longitudinal wall extend perpendicular from the top portion and the two transverse walls are for attaching to a non-horizontal surface of the railcar support;

a second side portion loosely coupled within the open chamber of the first side portion, the second side portion comprising two parallel transverse walls connected by a longitudinal wall, wherein the two transverse walls and the longitudinal wall extend at a downward angle from the first side portion and the two transverse walls are for attaching to the non-horizontal surface of the railcar support, and wherein the second side portion pivots within the open chamber of the first side portion to conform to the non-horizontal surface of the railcar support; and a bottom portion loosely coupled to the second side portion, the bottom portion comprising a plate for attaching to a bottom horizontal surface of the railcar support.

2. The railcar extension of claim 1, wherein the railcar support comprises a side sill, the top portion is for attaching to a top of the side sill, the first side portion and the second side portion are for attaching to a side of the side sill, and the bottom portion is for attaching to a bottom of the side sill.

3. The railcar extension of claim 1, wherein the railcar extension top portion couples to a post pad on a side sill.

4. The railcar extension of claim 1, wherein the railcar support comprises a spine car cross member support, the top portion is for attaching to a top end of the cross member support, the first side portion and the second side portion are for attaching to an end of the cross member support, and the bottom portion is for attaching to a bottom end of the cross member support.

5. The railcar extension of claim 1, wherein the depth of the railcar extension is based on a longitudinal position of the railcar extension on the railcar and the American Association of Railroads (AAR) clearance envelope at the longitudinal position on the railcar.

6. The railcar extension of claim 1, wherein the top portion and the first side portion are wider than the second side portion and the bottom portion.

7. The railcar extension of claim 6, wherein the second side portion and the bottom portion are centered with respect to the top portion and the first side portion.

8. The railcar extension of claim 6, wherein the second side portion and the bottom portion are offset with respect to the top portion and the first side portion to avoid obstructions on the railcar support.

9. A railcar comprising:

a plurality of railcar extensions;

each railcar extension of the plurality of railcar extensions comprising:

a top portion comprising a plate coupled to a top horizontal surface of a railcar support;

a first side portion coupled to the top portion, the first side portion comprising two parallel transverse walls connected by a longitudinal wall forming an open chamber between the walls, wherein the two transverse walls and the longitudinal wall extend perpendicular from the top portion and the two transverse walls are coupled to a non-horizontal surface of the railcar support;

a second side portion coupled to the first side portion, the second side portion comprising two parallel transverse walls connected by a longitudinal wall, wherein the two transverse walls and the longitudinal wall extend at a downward angle from the first side portion and the two transverse walls are coupled to the non-horizontal surface of the railcar support; and a bottom portion coupled to the second side portion, the bottom portion comprising a plate coupled to a bottom horizontal surface of the railcar support.

10. The railcar of claim 9, wherein the railcar support comprises a side sill, each top portion is coupled to a top of the side sill, each of the first side portions and the second side portions are coupled to a side of the side sill, and each of the bottom portions is coupled to a bottom of the side sill.

11. The railcar of claim 10, wherein the railcar extension top portion couples to a post pad on the side sill.

12. The railcar of claim 11, wherein the railcar comprises an autorack railcar comprising a plurality of side posts, and each side post of the plurality of side posts is coupled to a railcar extension of the plurality of railcar extensions.

13. The railcar of claim 10, wherein the railcar comprises a flatcar, and each railcar extension of the plurality of railcar extensions supports an extended width floor.

14. The railcar of claim 9, wherein the railcar support comprises a spine car cross member support, each of the top portions is coupled to a top end of the cross member support, each of the first side portions and the second side portions are coupled to an end of the cross member support, and each of the bottom portions is coupled to a bottom end of the cross member support.

15. The railcar of claim 9, wherein the depth of each railcar extension of the plurality of railcar extensions is based on a longitudinal position of the railcar extension on the railcar and the American Association of Railroads (AAR) clearance envelope at the longitudinal position on the railcar.

16. The railcar of claim 9, wherein the top portion and the first side portion are wider than the second side portion and the bottom portion.

17. The railcar of claim 16, wherein the second side portion and the bottom portion of at least one railcar extension are offset with respect to the top portion and the first side portion to avoid obstructions on the railcar support.

18. A method for extending the width of a railcar, the method comprising:

coupling a top portion of a railcar extension to a top horizontal surface of a railcar support;

coupling a first side portion of the railcar extension to the top portion of the railcar extension, the first side portion comprising two parallel transverse walls connected by a longitudinal wall forming an open chamber between the walls, wherein the two transverse walls and the longitudinal wall extend perpendicular from the top portion;

coupling the two transverse walls of the first side portion to a non-horizontal surface of the railcar support;

aligning a second side portion of the railcar extension to conform to the non-horizontal surface of the railcar support, the second side portion comprising two parallel transverse walls connected by a longitudinal wall, wherein the two transverse walls and the longitudinal wall extend at a downward angle from the first side portion;

coupling the second side portion of the railcar extension to the first side portion;

coupling the two transverse walls of the second side portion to the non-horizontal surface of the railcar support;

coupling a bottom portion of the railcar extension to the second side portion, the bottom portion comprising a plate; and coupling the bottom portion to a bottom horizontal surface of the railcar support.

19. The method of claim 18, further comprising coupling a side post to the top portion of the railcar extension.

20. The method of claim 18, further comprising coupling extended width flooring to the top portion of the railcar extension.

* * * * *